US010494143B2

(12) United States Patent
Kuo et al.

(10) Patent No.: US 10,494,143 B2
(45) Date of Patent: Dec. 3, 2019

(54) STACKABLE AND NESTABLE FOOD CONTAINMENT SYSTEM

(71) Applicant: EP Family Corp., Walnut, CA (US)

(72) Inventors: Hung-Chih Kuo, Walnut, CA (US); Peiling Chang Chien, Walnut, CA (US)

( * ) Notice: Subject to any disclaimer, the term of this patent is extended or adjusted under 35 U.S.C. 154(b) by 202 days.

(21) Appl. No.: 15/279,899

(22) Filed: Sep. 29, 2016

(65) Prior Publication Data

US 2018/0086500 A1 Mar. 29, 2018

(51) Int. Cl.

*B65D 21/00* (2006.01)
*B65D 21/02* (2006.01)
*B65D 1/36* (2006.01)

(52) U.S. Cl.

CPC ..... *B65D 21/0219* (2013.01); *B65D 1/36* (2013.01); *B65D 21/0233* (2013.01)

(58) Field of Classification Search

CPC ..... B65D 21/0219; B65D 21/0233; B65D 21/0209; B65D 21/02; B65D 21/0204; B65D 21/0201; B65D 1/24; B65D 1/36; B65D 2543/00027; B65D 2543/00731; B65D 43/0214; A47G 23/06

USPC ..... 220/4.26, 380, 500, 503, 507, 523, 781; 206/505, 508

See application file for complete search history.

(56) References Cited

U.S. PATENT DOCUMENTS 5,419,451 A * 5/1995 Bitel, Jr. ..... B65D 1/36 206/508
2010/0015310 A1* 1/2010 Wallace ..... A47G 19/06 426/505
2011/0210033 A1* 9/2011 Chhay ..... B65D 21/0222 206/505
2013/0004625 A1* 1/2013 Brummer ..... B65D 1/36 426/119

* cited by examiner

*Primary Examiner* — Andrew T Kirsch
*Assistant Examiner* — Elizabeth J Volz
(74) *Attorney, Agent, or Firm* — Tommy S F Wang; Wang IP Law Group, P.C.

(57) ABSTRACT

A stackable and nestable food containment system provides temporary storage of edible substances. The system comprises tray members and lids that have an interengageable relationship. The tray member has a bottom surface with at least one first groove. The lid has at least one second groove that substantially matches the first groove. The grooves are aligned to enable arrangement of the tray members in a stacked configuration, while also restricting lateral slippage between tray members. When the tray members are covered with their correlating lids and in arranged in a stacked arrangement, spillage is also inhibited. Each tray has at least one barrier that forms three separate compartments. The compartments serve to segregate different edible substances, and also create an interlocking arrangement between tray members in a nested configuration. The tray members and the lids are fabricated from a material that is microwavable and dishwasher safe.

19 Claims, 5 Drawing Sheets

STACKABLE AND NESTABLE FOOD CONTAINMENT SYSTEM

FIELD OF THE INVENTION

The present invention relates generally to a stackable and nestable food containment system. More so, the present invention relates to a nestable and stackable food containment system for the temporary storage of edible substances, characterized by the provision of a plurality of tray members and a plurality of lids that have an interengageable relationship and correlating grooves that enable stacking and nesting that restricts lateral slippage between tray members; whereby the tray members are defined by a grooved tray exterior bottom surface, a grooved tray interior bottom surface, a tray sidewall, a cavity, and at least one barrier that forms three compartments; whereby the lids are defined by a grooved edge, a grooved lid interior surface, and a grooved lid exterior surface that couples with the grooved tray exterior bottom surface.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Sealable food containers are known in the art. A typical food container has a base with an upwardly projecting sidewall integrally formed with a brim. The brim of the base is formed with a number of integral cooperating features including a reinforcing hoop and sealing surfaces. A lid is configured to fit the base and includes a dome as well as a lid brim configured to cooperate with the brim of the base.

Typically, take-out food is packaged in paper, paperboard, corrugated fiberboard, plastic, or foam food containers. It is known that food containers having partitioned sections and modular container units dimensioned for easy arrangement and use have proven to be effective in the organizing and storage of edible substances. In particular, self-stacking cardboard and plastic containers of varying styles and construction have proven to be effective in organizing and storing food products.

One common container is the oyster pail, a folded, waxed or plastic coated, paperboard container. Corrugated fiberboard and foam containers are to some extent self-insulating, and could be used for a wide variety of foods including cooked rice, moist dishes. Thermal bags and other insulated shipping containers have increased ability to control temperatures during transit.

Other proposals have involved stackable food containers. The problem with these containers is that they do not enable both stacking and nesting of the containers while inhibiting lateral shifting. Even though the above cited containers meets some of the needs of the market, a stackable and nestable food containment system that provides temporary storage of edible substances and comprises tray members and lids that have an interengageable relationship and correlating grooves that enable stacking and nesting, while also restricting lateral slippage between tray members is still desired.

SUMMARY

Illustrative embodiments of the disclosure are generally directed to a stackable and nestable food containment system. The stackable and nestable food containment system, hereafter "system", provides temporary storage of edible substances. The system comprises tray members and lids that have an interengageable relationship. The tray member has a bottom surface with at least one first groove. The lid has at least one second groove that substantially matches the first groove. The grooves are aligned to enable arrangement of the tray members in a stacked configuration, while also restricting lateral slippage between tray members. When the tray members are covered with their correlating lids and in arranged in a stacked arrangement, spillage is also inhibited. Each tray has at least one barrier that forms three separate compartments. The compartments serve to segregate different edible substances, and also create an interlocking arrangement between tray members in a nested configuration. The tray members and the lids are fabricated from a material that is microwavable and dishwasher safe.

In one embodiment, each tray member is defined by a tray exterior bottom surface, a tray interior bottom surface, a tray sidewall that terminates at a tray edge, and a cavity. The tray exterior and interior bottom surfaces are defined by at least one first groove. The tray member may further be defined by at least one barrier that forms three compartments in the cavity. When stacked, the compartments fit into each other when the tray members are in a nested arrangement.

In another embodiment, the lids are defined by a lid interior surface, a lid exterior surface, and a lid edge that forms a perimeter to the lid and is shaped and dimensioned to detachably couples to the tray edge. The lid interior and exterior surfaces are defined by at least one second groove that matches and detachably couples to a correlating first groove in the tray exterior bottom surface. The grooved edges of the lids are configured to detachably cover the tray members, and thereby prevent spillage.

The grooves also enable the covered tray members to be arranged in a stacked configuration. In this stacked configuration, the first grooves on the bottom tray surface and the second groove on the exterior lid surface align and mate. In one embodiment, the interlocking relationship between grooves works to inhibit lateral shifting of a first tray member relative to a similar second tray member.

When the lid is removed from the tray members, the tray members and lids may be arranged in a nested configuration for efficient storage and shipping. In the nested configuration, the compartments for each tray member fit into each other. Further, the at least one first groove of the tray member and the at least one second groove of the lids form correlating relationships that enable separate nesting of the tray members and the lids.

One objective of the present invention is to provide a plurality of tray members and lids that segregate and protectively cover edible substances.

Another objective is to arrange the tray members and attached lids in a stacked arrangement that inhibits lateral slippage.

Another objective is to arrange the tray members and lids individually in a nested arrangement that enhances storing and shipping.

Yet another objective is to provide a lid that easily covers and uncovers the cavity of the tray member.

Yet another objective is to segregate different edible substances in each compartment of the tray member.

Yet another objective is to provide at least one first groove on the bottom surface of the tray member that substantially matches a second groove in the lid.

Yet another objective is to provide a microwaveable, machine washable stackable and nestable food containment system.

Yet another objective is to provide an inexpensive to manufacture stackable and nestable food containment system.

Yet another objective is to inhibit a lateral shift of a first tray member relative to a similar second tray member in a second direction substantially perpendicular to the first direction and substantially parallel to the exterior bottom surface of the first tray member.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
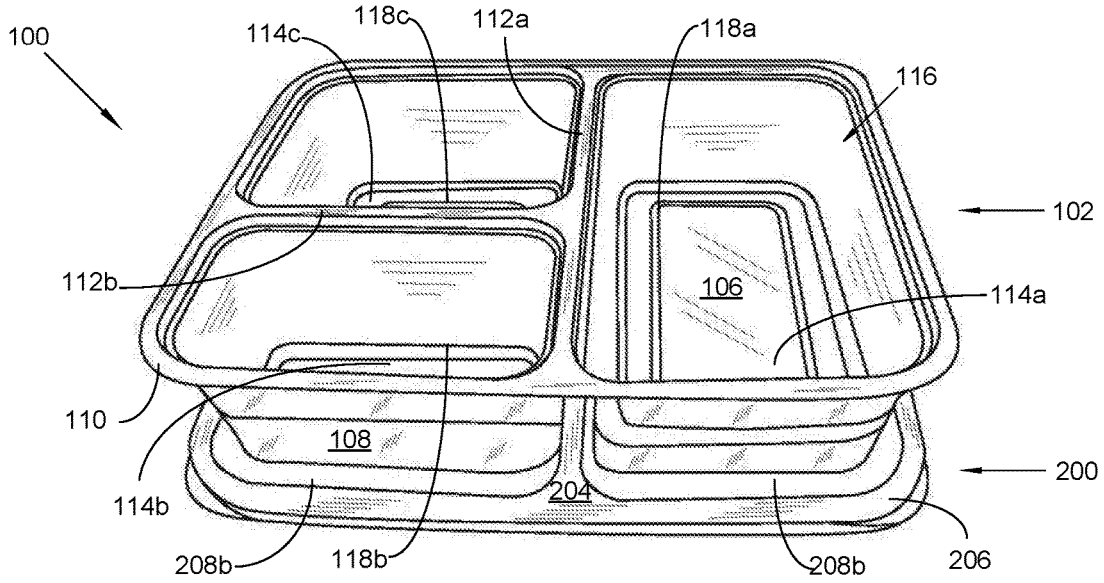
FIG. 1 illustrates a perspective view of an exemplary stackable and nestable food containment system, with an exemplary tray member stacked on an exemplary lid, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A stackable and nestable food containment system 100 is referenced in FIGS. 1-10. As referenced in FIG. 1, the stackable and nestable food containment system 100, hereafter "system 100", provides a plurality of tray members 102 structured to hold edible substances, and a plurality of lids 200 that fit over the top of the tray members 102 to seal and reclose the tray members 102 as the edible substances are removed. Each empty tray member 102 may be stackable on an adjacent lid 200, or arranged for shipment in nested fashion.

Figure 2:
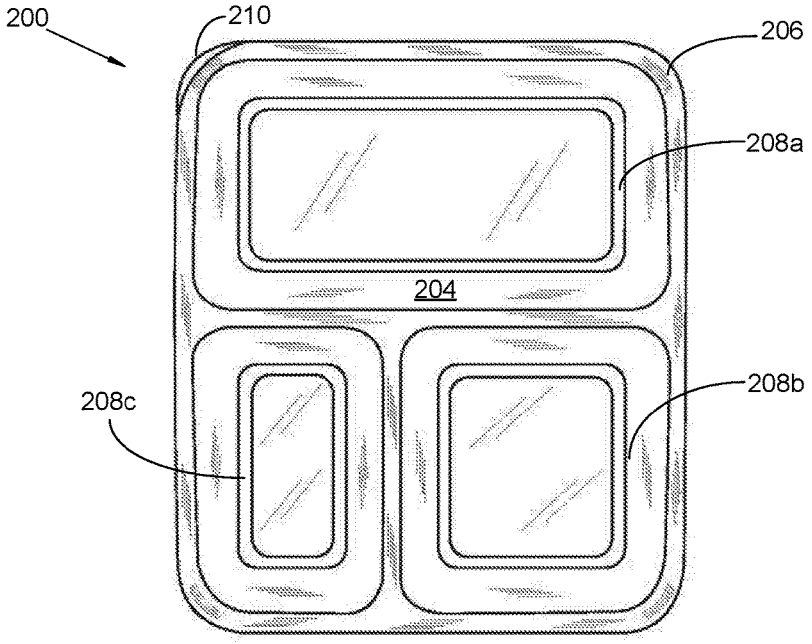
FIG. 2 illustrates a perspective view of a lid, showing a lid exterior surface, in accordance with an embodiment of the present invention.

When stacked, the tray members 102 are inhibited from laterally shifting due to grooves 118*a*, 118*b*, 118*c*, 208*a*, 208*b*, 208*c* that integrate into the bottom surface 106 of the tray members 102 and the exterior surface 204 of the lids 200 (FIG. 2). The grooves 118*a*, 118*b*, 118*c*, 208*a*, 208*b*, 208*c* are substantially matching to create an interlocking relationship between tray member 102*a* and corresponding lid 200*a*. When the tray members 102 are covered with the lids 200, and in a stacked arrangement, spillage is also inhibited.

In some embodiments, at least one barrier 112*a*, 112*b* traverses the cavity 116 of each tray member 102 to form three separate compartments 114*a*, 114*b*, 114*c*. The compartments 114*a*, 114*b*, 114*c* serve to segregate different edible substances, and also create an interlocking arrangement between tray members 102 in a nested configuration. When nested, the three compartments 114*a*, 114*b*, 114*c* also inhibits lateral shifting or easy separation. The tray members 102 and the lids 200 are fabricated from a microwavable and dishwasher safe material.

Figure 3:
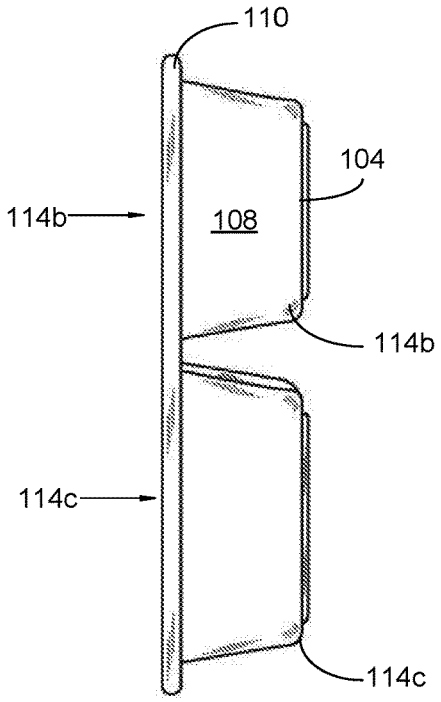
FIG. 3 illustrates an elevated side view of a tray member, in accordance with an embodiment of the present invention.

As referenced in FIG. 3, the system 100 comprises a plurality of tray members 102. The tray members 102 may include food take-out trays or other containers designed for storing and eating edible substances. In some embodiments, the tray members 102 may be microwaveable and machine washable to enable reusability and enhanced functionality. The tray members 102 may be at least partially transparent and flexible. Suitable materials for the tray members 102 may include, without limitation, a polymer, a low density polyethylene, a polystyrene, polypropylene, stainless steel, and wood.

Figure 4:
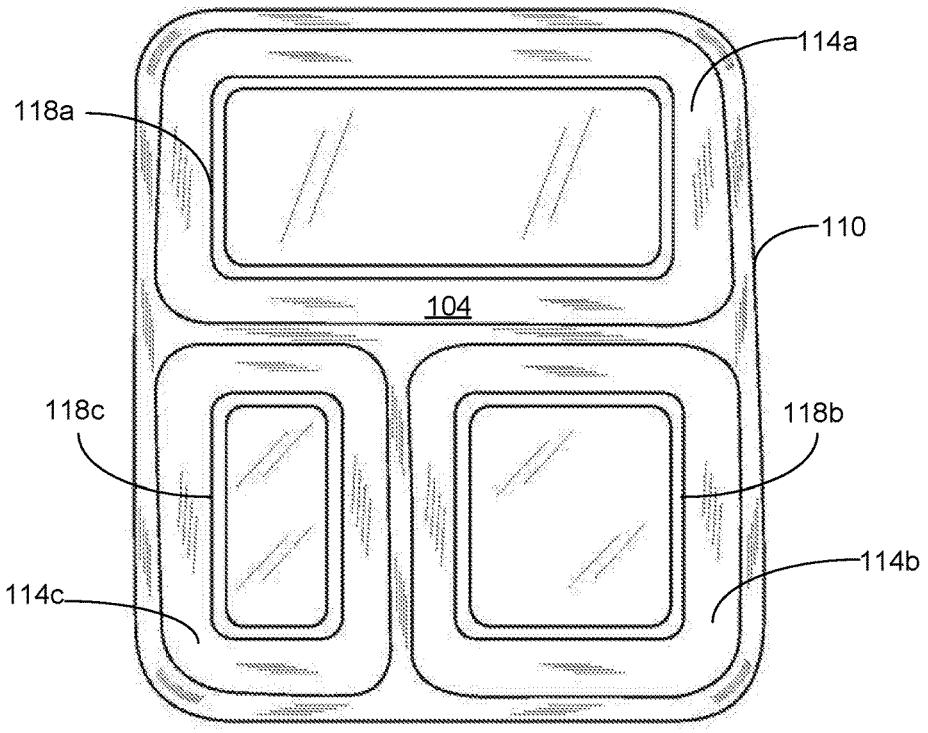
FIG. 4 illustrates a bottom view of a tray member, showing an exterior surface, in accordance with an embodiment of the present invention.

As illustrated in FIG. 4, each tray member is defined by a tray exterior bottom surface 104, a tray interior bottom surface 106, a tray sidewall 108 that terminates at a tray edge 110, and a cavity 116. The tray sidewall 108 may extend from the periphery of the tray bottom surfaces 104, 106, forming a generally square shape. Though in other embodiments, the tray sidewall 108 may form a rectangular, circular, or other elongated shape. The tray edge 110 may include a ridge that runs along the length of the tray edge 110.

The tray exterior and interior bottom surfaces 104, 106 are generally flat. Though in some embodiments, the bottom surfaces 104, 106 may be concave. The tray exterior and interior bottom surfaces 104, 106 are defined by at least one first groove 118*a*, 118*b*, 118*c*. The first groove 118*a*, 118*b*, 118*c* may be protruding or recessed into the tray bottom surfaces 104, 106, depending on the interior or exterior side of the tray bottom surface 104, 106.

Figure 5:
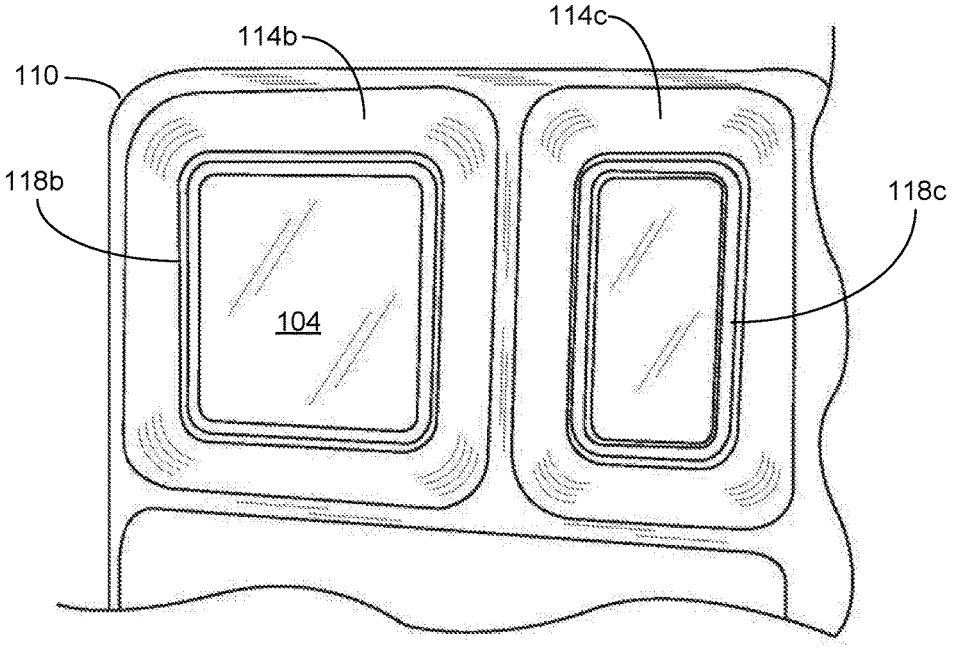
FIG. 5 illustrates a bottom view of two smaller compartments of a tray member, in accordance with an embodiment of the present invention.

As FIG. 5 illustrates, the first groove 118*a*, 118*b*, 118*c* forms a generally continuous loop shape. Though the first groove 118*a*, 118*b*, 118*c* may follow any number of patterns, depths, shapes, and textures. In one exemplary embodiment, a series of first grooves 118*a*, 118*b*, 118*c* form a concentric pattern, with one groove running in a loop around another, and another, etc.

Figure 6:
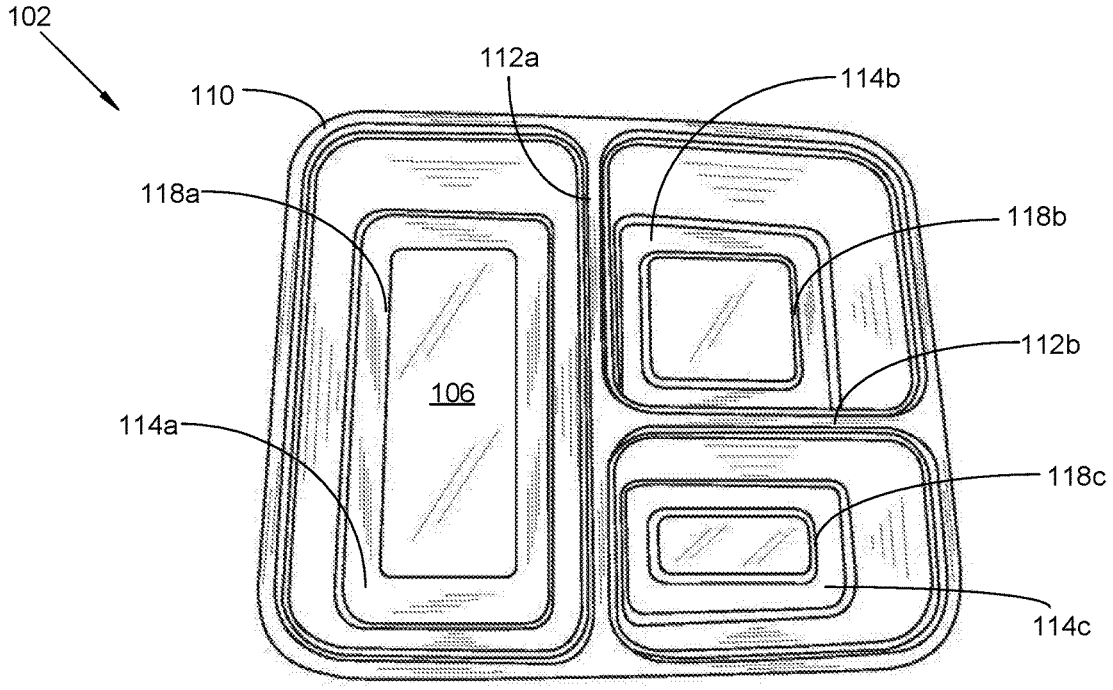
FIG. 6 illustrates a perspective view of a tray member, showing an interior bottom surface, in accordance with an embodiment of the present invention.

Looking now at FIG. 6, the tray members 102 may further be defined by at least one barrier 112*a*, 112*b* that is disposed to traverse the cavity 116 of the tray members 102. The barrier 112*a*, 112*bs* form multiple compartments 114*a*, 114*b*, 114*c* for segregating the edible substances in the cavity 116. In one embodiment, each tray member 102 has three separate compartments 114*a*, 114*b*, 114*c* for segregating different edible substances and for creating an interlocking arrangement between tray members 102.

For example, without limitation: a meat can be placed in a first compartment 114*a*; a vegetable in a second compartment 114*b*; and a jelly in a third compartment 114*c*. Though in other embodiments, liquids may also be placed in the compartments 114. Further, the compartments 114*a*, 114*b*, 114*c* may be sized differently, with a large first compartment 114*a* and smaller second and third compartments 114*b*, 114*c*.

In another embodiment, the compartments 114*a*, 114*b*, 114*c* from different tray members 102 fit into each other in a nested arrangement. This is possible because of the similar shape and positioning of compartments 114*a*, 114*b*, 114*c* for each tray member 102. Further, the proximal arrangement of compartments 114*a*, 114*b*, 114*c* relative to each other forms a substantially solid surface that is adaptable to stacking tray members 102, and creates additional stability in the stacked arrangement (See FIG. 1).

Figure 7:
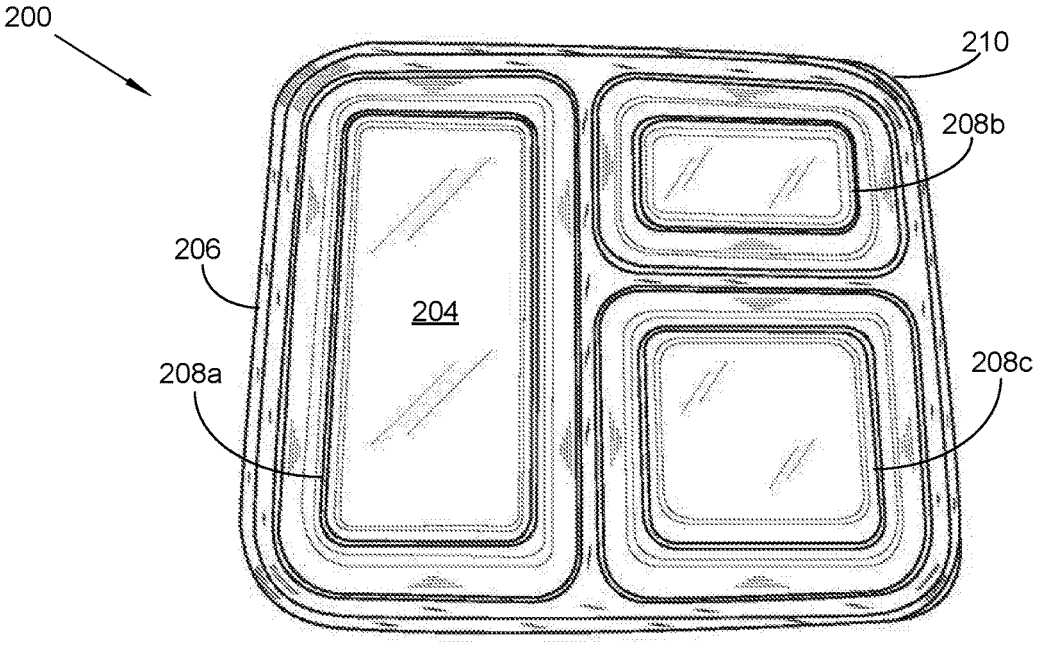
FIG. 7 illustrates a top view of a lid, showing a lid exterior surface, in accordance with an embodiment of the present invention.

Turning now to FIG. 7, the system 100 further comprises a plurality of lids 200 that are adapted to operate with the tray members 102. In some embodiments, the lids 200 may be generally flat and impermeable. The lids 200 may also be flexible and at least partially transparent. Though the physical characteristics may be altered to accommodate different types of edible substances and tray members 102.

Suitable materials for the lids 102 may include, without limitation, a polymer, a low density polyethylene, a polystyrene, polypropylene, stainless steel, and wood. The lids 102 may also be flexible to enable conformance to the tray edge 110 of the tray members 102.

Figure 8:
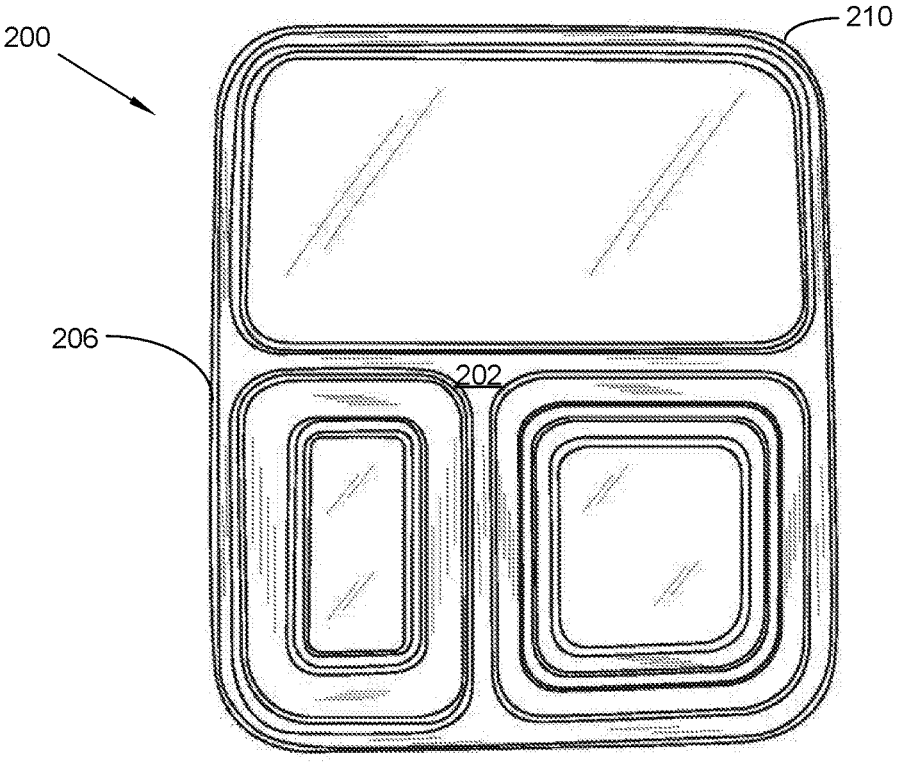
FIG. 8 illustrates a perspective view of a lid, showing a lid interior surface, in accordance with an embodiment of the present invention.

As illustrated in FIG. 8, the lids 200 are defined by a lid interior surface 202, a lid exterior surface 204, and a lid edge 206. The lid edge 206 forms a perimeter to the lid 200 and is shaped and dimensioned to detachably couple to the tray edge 110. A tab 210 may extend from one corner of the lid edge 206 to facilitate removal of lid 200 from tray member 102.

In one embodiment, the lid edge 206 is a depression that runs along the length of the lid edge 206. The lid edge 206 may form a friction fit, or snap-fit relationship with the tray edge 110. The edges 110, 206 form a sealed relationship to maintain freshness of the edible substances contained in the cavity 116.

Similar to the bottom surfaces 104, 106 of the tray members 102, the lid interior and lid exterior surfaces 202, 204 are defined by at least one second groove 208*a*, 208*b*, 208*c*. The second groove 208*a*, 208*b*, 208*c* substantially matches the shape and size of the first groove 118*a*, 118*b*, 118*c* in the bottom surfaces 104, 106 of the tray members 102*a*, 102*b*. In one embodiment, a series of second grooves 208*a*, 208*b*, 208*c* form a concentric pattern, with one groove running in a loop around another, and another.

The second groove 208*a*, 208*b*, 208*c* is configured to detachably couple to a correlating first groove 118*a*, 118*b*, 118*c* in the tray exterior bottom surface 104. In one embodiment, the second groove 208*a*, 208*b*, 208*c* of the lid 200 forms a generally continuous loop shape. Though the second groove 208*a*, 208*b*, 208*c* may follow any number of patterns, depths, shapes, and textures.

Figure 9:
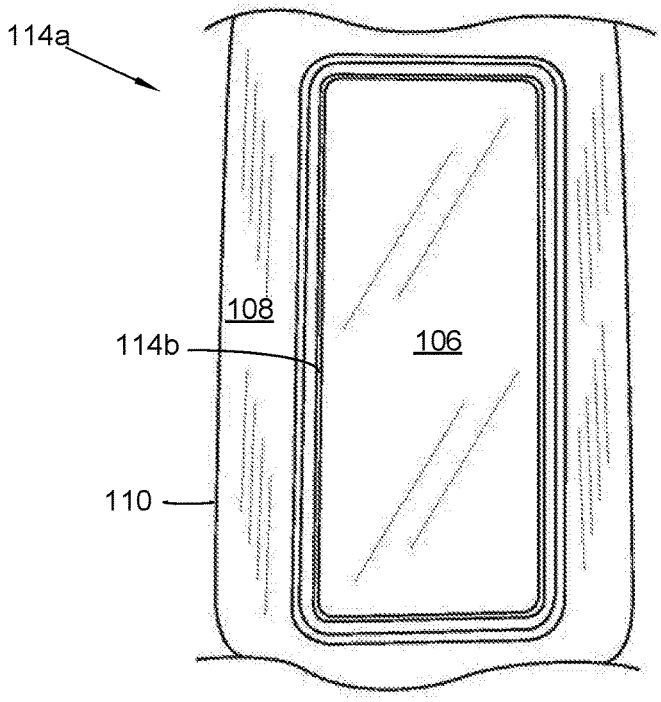
FIG. 9 illustrates a perspective view of a first compartment of a tray member, showing an interior surface, in accordance with an embodiment of the present invention.

The grooved edge 206 of the lid 200*a* are configured to detachably mate with the tray edge 110, and thereby enable the lid 200*a* to cover the tray member 102*a* for preventing spillage of edible substances. FIG. 9 illustrates a compartment 114*a* of the tray member 102 sized to engage the lid shown in FIG. 10. The compartments 114*a-c* match similar shaped sections of the lid 200 to create a seal. The grooves 118*a-c*, 208*a-c* from both tray member 102 and lid 200 also match in alignment to form a stable stacked arrangement.

Thus, when the tray member 102*a* is sealed, the edible substance in the cavity 116 is prevented from spilling, and also leakage of food between each compartment 114*a*, 114*b*, 114*c* is prevented. Furthermore, covering the tray member 102*a* with the lid 200*a* enables multiple tray members 102 to be arranged in a stacked configuration.

In this stacked configuration, the first groove 118*a*, 118*b*, 118*c* on the bottom tray surfaces 104, 106 and the second groove 208*a*, 208*b*, 208*c* on the lid exterior surface 204 can align and mate. In one embodiment, the interlocking relationship between grooves 118*a*, 118*b*, 118*c*, 208*a*, 208*b*, 208*c* works to inhibit lateral shifting of a first tray member 102*a* relative to a similar second tray member 102*b* in a second direction substantially perpendicular to the first direction and substantially parallel to the exterior bottom surface 104 of the first tray member 102*a*.

Figure 10:
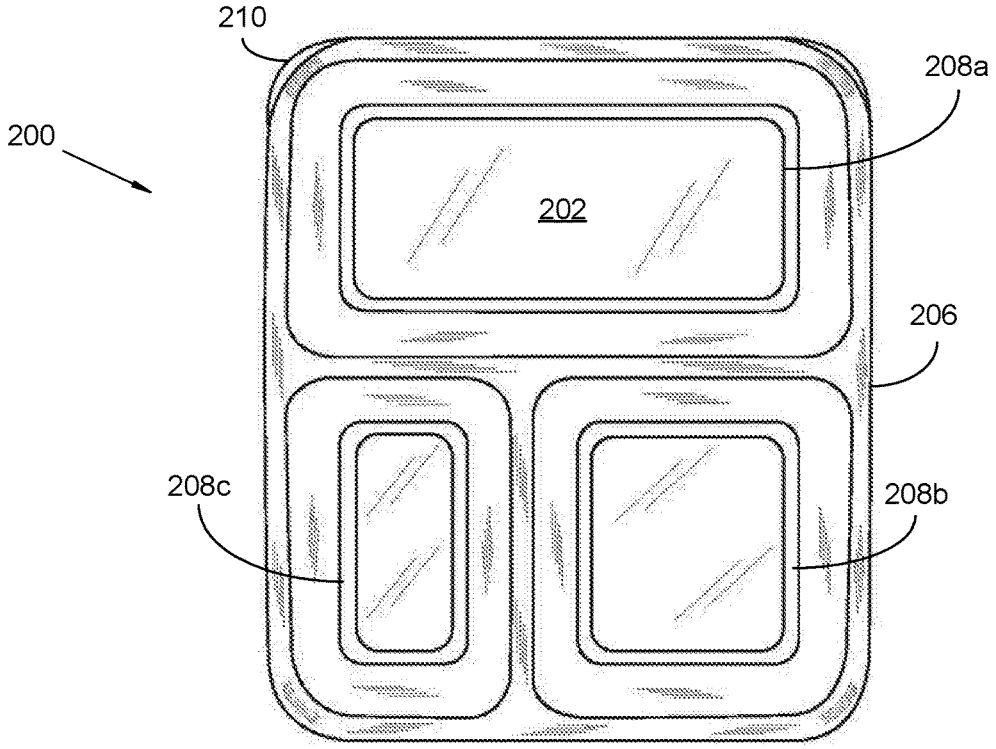
FIG. 10 illustrates a top view of a lid, showing an interior surface, in accordance with an embodiment of the present invention.

When the lids 200 are removed from the tray members 102, the tray members 102 and lids 200 may be arranged separately in a nested configuration for efficient storage and shipping. In the nested configuration, the compartments 114*a*, 114*b*, 114*c* for each tray member 102 fit into each other. Further, the at least one first groove 118*a*, 118*b*, 118*c* of the tray members 102 and the at least one second groove 208*a*, 208*b*, 208*c* of the lids 200 form correlating relationships that enable separate nesting of the tray members 102 and the lids 200 (FIGS. 9 and 10).

In operation, a user may place edible substances in each of the three compartments 114*a*, 114*b*, 114*c* of the tray members 102. The lids 200 may be snapped onto the tray edge 110 to seal the edible substance in the cavity 116 of the tray members 102. Multiple tray members 102 may be stacked with the first groove 118*a*, 118*b*, 118*c* from the tray exterior bottom surface 104 mating with the second groove 208*a*, 208*b*, 208*c* in the lid exterior surface 204. The tray members 102 may then be carried in a stacked configuration with no lateral shifting between tray members 102 or spillage from the cavity 116 of the tray members 102. Further, multiple empty tray members 102 may be nested into each other, with the compartments 114*a*, 114*b*, 114*c* aligning to receive each other.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A stackable and nestable food containment system, the system comprising:

a plurality of tray members defined by a tray exterior surface, a tray interior surface, a tray sidewall terminating at a tray edge, and at least one barrier configured to form a first compartment, a second compartment and a third compartment in the cavity of the plurality of tray members, wherein the first compartment and the second compartment are generally rectangular and the third compartment is generally square;

a first tray groove a second tray groove and a third tray groove configured to integrate into the tray exterior surface and the tray interior surface, wherein a first tray joint portion, a second tray joint portion, a third tray joint portion, a first tray engage portion, a second tray engage portion and a third tray engage portion are formed by the first tray groove, the second tray groove and the third tray groove correspondingly, wherein the first tray groove and the second tray groove are generally rectangular and the third tray groove is generally square;

a plurality of lids defined by a lid interior surface lid exterior surface, and a lid edge, the plurality of lids configured to detachably cover the cavity of the plurality of tray members, whereby the tray edge detachably couples to the lid edge; and a first lid groove, a second lid groove and a third lid groove configured to integrate into the lid interior surface and the lid exterior surface, the first lid groove is configured to substantially match the first tray groove, the second lid groove is configured to substantially match the second tray groove, the third lid groove is configured to substantially match the third tray groove, wherein a first lid joint portion, a second lid joint portion, a third lid joint portion, a first lid engage portion, a second lid engage portion and a third lid engage portion are formed by the first lid groove, the second lid groove and the third lid groove correspondingly, wherein the first lid groove and the second lid groove are generally rectangular and the third lid groove is generally square, whereby alignment of the first tray groove with the first lid groove, alignment of the second tray groove with the second lid groove and alignment of the third tray groove with the third lid groove are aligned in a coplanar relationship, inhibiting lateral shifting of the covered plurality of tray members while in a stacked configuration, whereby the first compartment, the second compartment and the third compartment for each tray member are configured to nest with the first compartment, the second compartment and the third compartment of the another uncovered plurality of tray members correspondingly while in a nested configuration.

2. The system of claim 1, wherein the plurality of tray members comprises a food takeout tray.

3. The system of claim 1, wherein the three compartments of the plurality of tray members are configured to enable containment of an edible substance.

4. The system of claim 1, wherein the plurality of tray members are machine washable.

5. The system of claim 1, wherein the material composition of the plurality of tray members includes at least one member selected from the group consisting of: a polymer, a polystyrene, a low density polyethylene, polypropylene, stainless steel and wood.

6. The system of claim 1, wherein the tray sidewall forms a generally square shape.

7. The system of claim 1, wherein the at least one barrier comprises two barriers traversing the cavity.

8. The system of claim 1, wherein the first tray groove, second tray groove and third tray groove comprises a generally continuous loop shape.

9. The system of claim 1, wherein the tray edge comprises a ridge.

10. The system of claim 9, wherein the lid edge comprises a depression configured to mate with the ridge of the tray edge.

11. The system of claim 1, wherein the tray edge is configured to have a friction fit relationship with the lid edge.

12. The system of claim 1, wherein the material composition of the plurality of lids includes at least one member selected from the group consisting of: a polymer, a low density polyethylene, a polystyrene, polypropylene, stainless steel, and wood.

13. The system of claim 1, wherein, the plurality of lids form a generally square shape.

14. The system of claim 1, replaced with wherein the first lid groove, second lid groove and third lid groove comprises a generally continuous loop shape.

15. The system of claim 1, wherein the plurality of are configured to seal the plurality of compartments.

16. The system of claim 1, wherein the plurality of tray members and the plurality of tray members are at least partially transparent.

17. The system of claim 1, wherein the plurality of tray members and the plurality of tray members are flexible.

18. A stackable and nestable food containment system, the system comprising:

a plurality of tray members defined by a tray exterior surface, a tray interior surface, a tray sidewall terminating at a tray edge, and two barriers configured to form a first compartment, a second compartment and a third compartment in the cavity of the plurality of tray members, wherein the first compartment and the second compartment are generally rectangular and the third compartment is generally square;

a first tray groove, a second tray groove and a third tray groove configured to integrate into the tray exterior surface and the tray interior surface, wherein a first tray, joint portion, a second tray joint portion, a third tray joint portion, a first tray engage portion, a second tray engage portion and a third tray engage portion are formed by the first tray groove, the second tray groove and the third tray groove correspondingly, wherein the first tray groove and the second tray groove are generally rectangular and the third tray groove is generally square;

a plurality of lids defined by a lid interior surface, a exterior surface, and a lid edge, the plurality of lids configured to detachably cover the cavity of the plurality of tray members, whereby the tray edge detachably couples to the lid edge ire a friction fit relationship;

a tab configured to extend from the lid edge; and a first lid groove, a second lid, groove and a third lid groove configured to integrate into the lid interior surface and the lid exterior surface, the first lid groove is configured to substantially match the first tray groove, the second lid groove is configured to substantially match the second tray groove, the third lid groove is configured to substantially match the third tray groove, wherein a first lid joint portion, a second lid joint portion, a third lid joint portion, a first lid engage portion, a second lid engage portion and a third lid engage portion are formed by the first lid groove, the second lid groove and the third lid groove correspondingly, wherein the first lid groove and the second lid groove are generally rectangular and the third lid groove is generally square, whereby alignment of the first tray groove with the first lid groove, alignment of the second tray groove with the second lid groove and alignment of the third tray groove with the third lid groove are aligned in a coplanar relationship, inhibiting lateral shifting of the covered plurality of tray members while in a stacked configuration, whereby the first compartment, the second compartment and the third compartment for each tray member are configured to nest with the first compartment, the second compartment and the third compartment of the another uncovered plurality of tray members correspondingly while in a nested configuration.

19. The system of claim 18, wherein the first tray groove, second tray groove and third tray groove and the first lid groove, second lid groove and third lid groove comprise a generally continuous loop shape.

* * * * *